US011166514B2

(12) United States Patent
Hajianpour

(10) Patent No.: US 11,166,514 B2
(45) Date of Patent: Nov. 9, 2021

(54) HELMET/HOOD ASSEMBLY STRUCTURE AND METHOD TO PREPARE FOR USE

(71) Applicant: Mohammed A. Hajianpour, Fort Lauderdale, FL (US)

(72) Inventor: Mohammed A. Hajianpour, Fort Lauderdale, FL (US)

( * ) Notice: Subject to any disclaimer, the term of this patent is extended or adjusted under 35 U.S.C. 154(b) by 371 days.

(21) Appl. No.: 14/605,213

(22) Filed: Jan. 26, 2015

(65) Prior Publication Data

US 2017/0000207 A1 Jan. 5, 2017

(51) Int. Cl.

| | |
|---|---|
| ***A42B 3/28*** | (2006.01) |
| ***A42B 3/04*** | (2006.01) |
| ***A42B 3/22*** | (2006.01) |
| ***A42B 3/14*** | (2006.01) |

(52) U.S. Cl.

CPC ..... *A42B 3/286* (2013.01); *A42B 3/044* (2013.01); *A42B 3/145* (2013.01); *A42B 3/225* (2013.01); *A42B 3/281* (2013.01)

(58) Field of Classification Search

CPC ..... F21V 21/08; A61F 9/06; A41D 13/1153; A41D 13/11; A42B 3/286; A42B 3/281; A42B 3/145; A42B 3/044; A42B 3/225; A42B 3/085; A42B 3/04; A42B 3/322; A42B 3/32; A42B 3/006; A42B 3/14; A42B 3/324; A42B 3/08; A42B 3/20; A42B 3/22; A42B 3/222; A42B 3/326; A42B 3/328; A42B 3/226; A62B 18/04; A62B 18/045; A61B 1/06; A61B 1/20; A61B 1/201

USPC ..... 2/457, 420, 418, 417, 171.3, 15; 128/201.19, 201.25, 200.28; 600/249; 362/105

See application file for complete search history.

(56) References Cited

U.S. PATENT DOCUMENTS

| | | | | |
|---|---|---|---|---|
| 3,685,054 A * | 8/1972 | Raschke | A42B 3/225 | 2/10 |
| 3,991,422 A * | 11/1976 | Saotome | A42B 3/322 | 2/410 |
| 4,730,612 A * | 3/1988 | Dampney | A62B 18/045 | 128/201.24 |
| 5,628,071 A * | 5/1997 | Nezer | A42B 3/322 | 2/410 |
| 6,374,823 B1 | 4/2002 | Hajianpour | | |
| 7,264,368 B2 * | 9/2007 | Sherring | A42B 3/04 | 2/906 |

(Continued)

FOREIGN PATENT DOCUMENTS

| | | | | |
|---|---|---|---|---|
| EP | 2117367 A1 * | 11/2009 | A41D 13/1153 | |
| WO | 2008106135 | 9/2008 | | |

(Continued)

*Primary Examiner* — Nathan E Durham
*Assistant Examiner* — Abby M Spatz
(74) *Attorney, Agent, or Firm* — Withers & Keys, LLC

(57) ABSTRACT

A helmet/hood assembly includes a housing, a support ring subassembly configured to hold the assembly on a human head, a face shield, and a flexible hood attached to the housing and to the face shield, with the assembly being received, stored, used, and disposed as a single unit. The support ring subassembly pivots on the housing between a position suitable for shipping and storing the assembly and a position in which the assembly is worn. An accessory light powered by a battery may be held in place on the housing by magnetic attraction through the hood.

19 Claims, 4 Drawing Sheets

(56) References Cited

U.S. PATENT DOCUMENTS

| | | | | |
|---|---|---|---|---|
| 7,357,135 | B2 * | 4/2008 | Cunningham | A42B 3/286 128/201.22 |
| 7,937,775 | B2 | 5/2011 | Manzella et al. | |
| 8,020,552 | B2 | 9/2011 | Dillon et al. | |
| 9,980,529 | B1 | 5/2018 | Hajianpour | |
| 2001/0032348 | A1 * | 10/2001 | Diaz | A41D 13/11 2/171.3 |
| 2007/0089221 | A1 * | 4/2007 | Manzella, Jr. | A41D 13/0025 2/456 |
| 2008/0202509 | A1 | 8/2008 | Dillon et al. | |
| 2014/0039273 | A1 * | 2/2014 | Kim | A61B 90/35 600/249 |
| 2015/0151070 | A1 * | 6/2015 | Capra | A61M 16/0644 128/207.11 |
| 2015/0327617 | A1 * | 11/2015 | Gaudillere | A42B 3/085 2/417 |

FOREIGN PATENT DOCUMENTS

| | | | | |
|---|---|---|---|---|
| WO | WO 2014160149 | A2 * | 10/2014 | A42B 3/286 |
| WO | WO-2014160149 | A2 * | 10/2014 | A62B 18/082 |

* cited by examiner

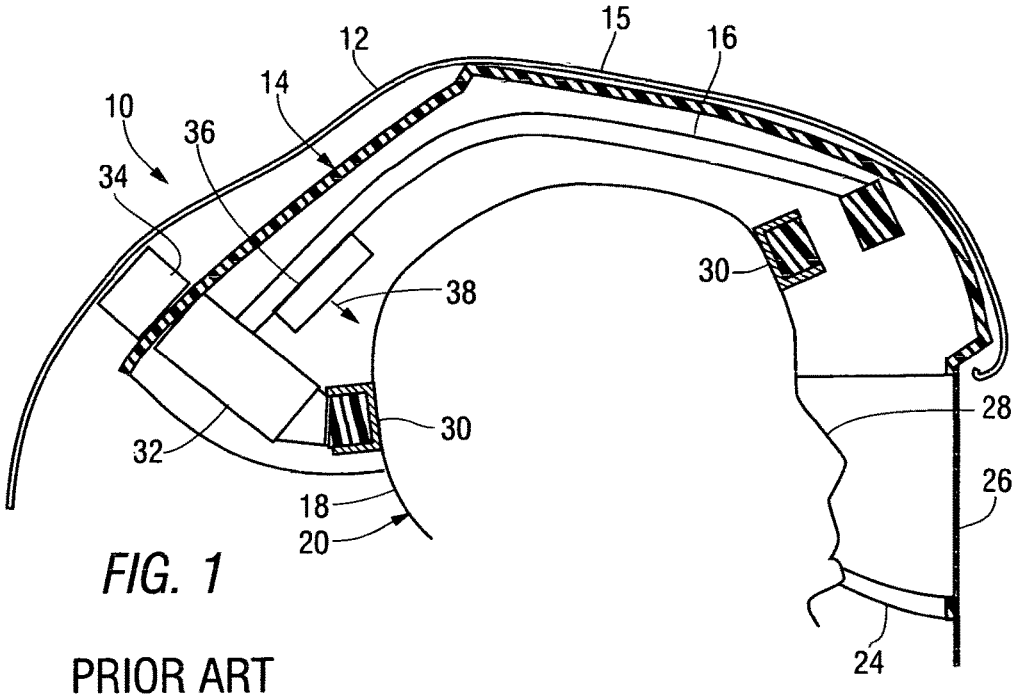
FIG. 1
PRIOR ART
FIG. 2
PRIOR ART
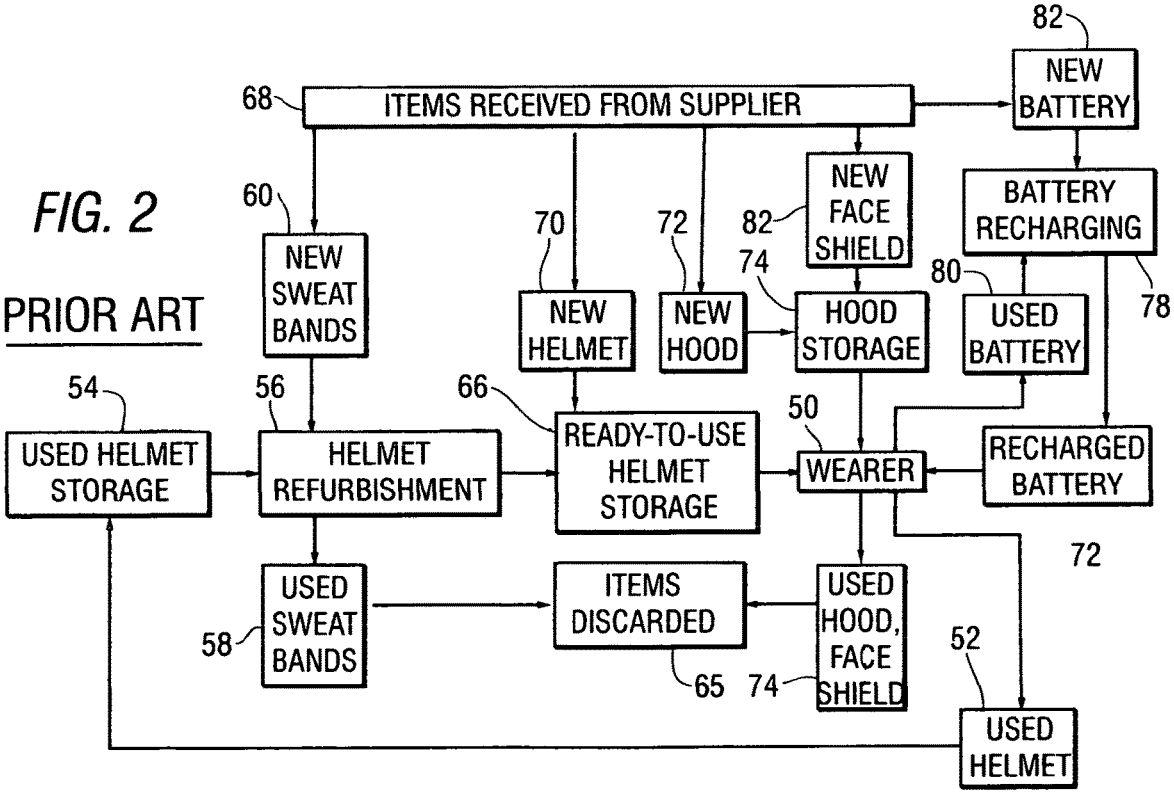

FIG. 6
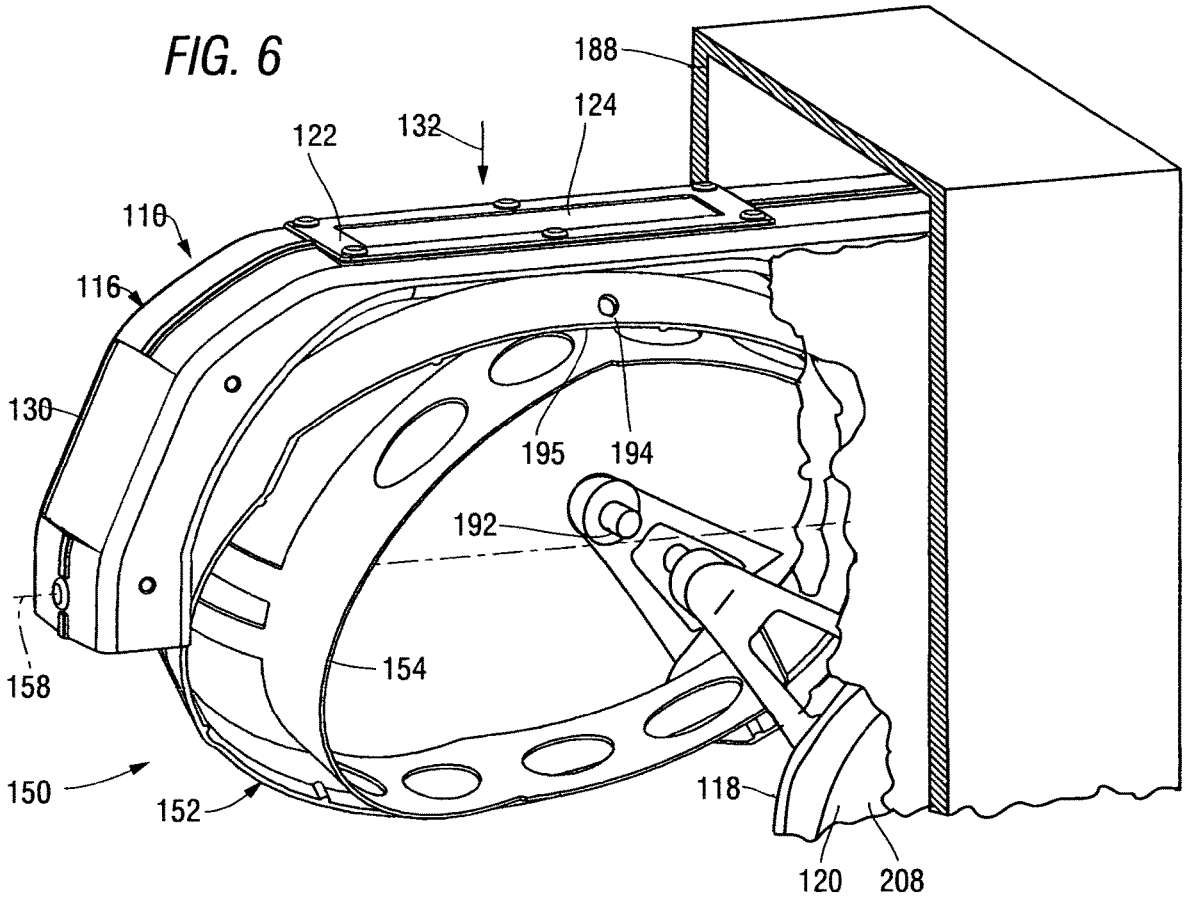
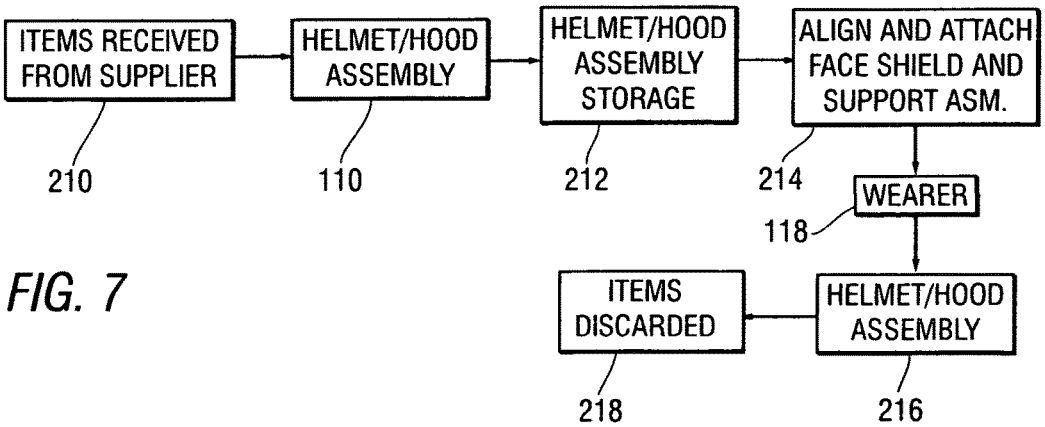
FIG. 7

HELMET/HOOD ASSEMBLY STRUCTURE AND METHOD TO PREPARE FOR USE

RELATED APPLICATIONS

Not Applicable

FEDERALLY SPONSORED RESEARCH OR DEVELOPMENT

Not Applicable

BACKGROUND OF THE INVENTION

1. Field of the Invention

This invention relates to a helmet/hood assembly to be worn by surgical personnel and, more particularly, to such a helmet/hood assembly having a structure and assembly process configured to provide for a significantly reduction in the space required for storing the helmet/hood assembly.

2. Summary of the Background Information

For thousands of years, people have made and worn various types of helmets to provide protection of the head from physical injury in war, sports, various occupations, and in forms of transportation, such as riding a bicycle or motorcycle, in which the head is exposed. When a suitable helmet was worn, the head was protected against blunt trauma, cutting edges, and projectiles, with helmets being strong, rigid, and designed to extend over the entire head. In the 1960's and 1970's it became apparent that a different kind of helmet was needed to protect operating room personnel and patients undergoing surgical procedures from contamination by one another. Specifically, a system was needed to provide separate airspaces in which each of the operating room personnel would breath and in which the surgical procedure would occur, so that the surgical site would not be contaminated by airborne contaminates exhaled or otherwise expelled by the operating room personnel, and additionally so that the operating room personnel will not be contaminated by blood splatter and other airborne contamination from the surgical site.

This need has been filled by a number of types of ventilated helmet/hood systems, each including a flexible hood, a transparent face shield, and a rigid helmet extending under the flexible hood to hold the flexible hood in place. Initially, air was supplied to a space within the helmet through a flexible hose from supply of clean air. However, since the air supply connections through hoses placed too many limitations on the movements of the operating room personnel, a portable air supply was developed, with an electrically-driven fan attached to the waist of each operating room person drawing air from behind his back, and with the air being supplied to his helmet through a flexible tube.

Then, circa 1975, the fan was instead placed within the helmet, forming a type of system shown in the schematic view of FIG. 1 that has become widely used as the conventional ventilated helmet/hood apparatus 10 for operating room personnel. The helmet/hood apparatus 10 includes a flexible hood 12 placed over a helmet 14, which supports the hood 12, giving its top portion 15 shape. The helmet 14 in turn includes a support assembly 16 configured for engaging the head 18 of the wearer 20, a housing 22, and a frame 24 configured for holding a transparent face shield 26 in front of the face 28 of the wearer 20. The support assembly 16 includes replaceable sweat bands 30 that are configured to be held against the head 18 and an adjustment mechanism 32 that adjusts the spacing between the sweat bands 20 to fit the head 48 in response to the rotation of an adjustment knob 34. Both the sweat bands 30 and the face shield 26 are replaced after each use, being adhesively attached within the helmet 14. The apparatus 10 further includes a fan 36 moving air in the direction of arrow 38 within the helmet 14.

A first limitation of the conventional approach using the helmet/hood apparatus 10 arises from the fact that the helmet 18 has been designed as a traditional helmet that completely surrounds the head of the wearer, protecting the head from injury due to blows. Therefore, the helmet 18 is unnecessarily large, resulting in increased costs for shipping and storage, and heavy, resulting in added discomfort for the wearer.

A second limitation of the conventional approach using the helmet/hood apparatus 10 arises from the fact that, while structures within the helmet 14 may include slots 36 allowing air movement, there are no openings within the upper portion 15 of the hood 12 through which fresh air can be drawn, or through which air may be exhausted. While some air is allowed to move inward and outward through spaces between the body of the wearer 20 and a lower edge (not shown) of the hood 12, a lack of air paths through the upper portion 15 of the hood implies that the vast majority of the air moved by the fan 36 is being recirculated within the helmet/hood apparatus 10 as levels of carbon dioxide within the apparatus 10 are allowed to rise, resulting in a possible reduction in the level of the technical skills of the medical personnel wearing the apparatus 10.

A third limitation of the conventional approach using the helmet/hood apparatus 10 arises from the fact that the adjustment knob 34 is located at the rear of the helmet 14. If the wearer 20 determines that the support assembly 16 is too loose or too tight, he cannot remove one of his hands from the sterile field to reach the knob 24 behind his head. He must instead have another individual perform the adjustment.

The helmet 14 is conventionally reused by other users 20 in other surgical procedures, while the hood 12 and face shield 26, which are each directly exposed to contamination by blood splatter during surgery, and the sweat bands 30 are replaced following each use of the helmet/hood 10. A rechargeable battery, attached to the wearer 20 by a belt, is connected to the helmet 14 power the fan 36.

FIG. 2 is a schematic view of the flow of parts within a hospital to provide helmet/hood apparatus as needed for operating room personnel. In this process, the vast majority of the helmets that are provided for operating room personnel, indicated as wearers 50, begin as used helmets 52, which are stored in a helmet storage area 54 and refurbished in an area 56, with the refurbishment process replacing used sweat bands 58 with new sweat bands 60 and including cleaning the used helmets, with a refurbished helmet being then placed in ready-to-use helmet storage 66. The new sweat bands 60 are obtained from one or more suppliers, indicated herein as 68. New helmets 70 can also be obtained in this way for placement in ready-to-use helmet storage 68. New hoods 72 and new face shields 73 are additionally obtained from suppliers 68, being attached to one another and placed in hood storage 74. Since hoods and face shields are not reused, used hoods and face shields 74 are discarded at 65.

As a wearer 50 is prepared for surgery, a helmet from ready-to-use helmet storage 66 is placed on his head and adjusted to fit using the adjustment knob 34. Then, a hood from hood storage 74 is placed over the helmet and over his shoulders. After the gown is placed on the wearer 50, since electrical power is required to operate the fan 36, a rechargeable battery 76, having been taken from a battery recharging area 78, is placed in the pocket of the gown worn by the wearer 50 or otherwise attached to his clothing and electrically connected to the fan 36. After the surgical procedure is completed, the wearer 50 removes the used helmet 52, which is returned to used helmet storage 54, the used hood and face shield 74, which are discarded at location 65, and a used battery 80, which is then stored and recharged at the recharging station 78, New batteries 82 may additionally be obtained from a supplier at 68 and placed into the recharging station 78.

A fourth limitation of the conventional approach using the helmet/hood apparatus 10 arises from the complexity of the process for preparing the apparatus 10 for use, with the replaceable items, the hood 12, face shield 26, and sweat pads 30 being separately received and installed, and with significant space being devoted to the storage and refurbishment of used helmets.

A fifth limitation of the conventional approach using the helmet/hood apparatus 10 arises from the fact that, the remaining portions of the helmet 14 are reused by multiple people, often additionally in multiple locations within a large facility, giving rise to a possibility of various kinds of cross-contamination. Including the spreading of disease from one location to another and among patients and hospital workers coming into contact with the used helmets.

A sixth limitation of the conventional approach using the helmet/hood apparatus 10 arises from the use of rechargeable batteries, which limits the use of the apparatus 10 to areas where electricity is available for recharging the battery, providing particular problems in remote areas and in disaster areas.

SUMMARY OF THE INVENTION

In accordance with a first aspect of the invention, the helmet within a helmet/hood assembly is built with an open construction, having a housing from which a headband configured to extend around a human head extends horizontally and laterally outward resulting in significant savings in weight and manufacturing cost. For example, the apparatus includes a housing, a support ring subassembly, a face shield, and a hood is provided. The housing includes front and rear portions, two opposite lateral sides, and upper and lower surfaces. The support ring subassembly includes a headband, configured to fit around a human head, extending outward from each of the opposite sides of the housing. The face shield, which includes a flexible transparent film sheet, is attached to the housing, being configured to extend downward from the front portion of the housing in front of the face of a human head held in the headband. The hood, which includes a sheet of flexible material, is fastened to the housing to extend downward and outward from the upper surface. The hood includes a front opening extending around the face shield. (Directional terms expressed herein are understood to signify directions within the helmet/hood apparatus as worn by a standing user facing the front.)

Preferably, the support ring subassembly is additionally rotatable into a position requiring less space for storing and transporting the helmet/hood assembly. For example, the housing additionally includes a central portion extending between the front and rear portions, with the support ring subassembly additionally being disposed between the front and rear portions and below the central portion. The support ring subassembly is then pivoted about a longitudinal axis extending between the front and rear portions of the housing. The support assembly can be rotated through a ninety-degree angle between an operational position, in which headband extends horizontally outward from each of the two opposite lateral sides through a substantial distance, and a storage position, in which the headband extends vertically beneath the central portion with the support ring subassembly in the storage position. Preferably, the face shield is attached to the support subassembly in the operational position, holding the support ring subassembly in the operational position.

Preferably, the headband is configured to be adjusted on the human head, using an adjustment knob disposed in front of the housing, but in a position underlying the hood, so that the wearer can use the knob to adjust the headband without removing his hands from the sterile field established within the surgical procedure. For example, the adjustment knob is attached to an advisement shaft extending outward from the front portion of the housing. Turning the adjustment knob in a first direction causes the headband to tighten while turning the knob in the opposite direction causes the headband to loosen. The adjustment shaft may be coaxial with the longitudinal axis. For example, such adjustments may occur within a slotted member forming part of the support ring subassembly, with the apparatus additionally including an adjustment gear attached to the adjustment shaft and disposed within the slotted member, and with the headband including a curved central portion and opposite end portions having racks extending within the slotted bracket to engage opposite sides of the adjustment gear.

Preferably, the housing serves as an air duct moving air from a space above the helmet/hood assembly to a the upper surface of the housing includes an air inlet, while the lower cover of the housing includes an air outlet disposed inwardly adjacent the face shield, and while the housing holds an electrically powered fan moving air from the air inlet to the air outlet within the housing. Then the hood includes an air inlet held adjacent the air inlet within the housing and a posterior air outlet disposed below the rear portion of the howith the housing serving as an air duct. The housing may additionally include a battery providing electrical power for the fan, which is electrically connected to the fan only when the support ring subassembly is in the operational position, allowing the fan to be automatically turned on during the process of preparing the helmet/hood assembly for use.

In accordance with a second aspect of the invention a packaged helmet/hood assembly is provided. For example, apparatus including a package and a helmet/hood assembly enclosed within the package, is provided, with the helmet/hood assembly including a housing, a support ring subassembly including a headband configured to extend around a human head, a face shield extending downward from a front end of the housing, and a hood including a sheet of flexible material.

Preferably, the packaged helmet/hood assembly occupies a significantly reduced space during shipment and storage, taking advantage of features provided within the helmet/hood assembly. For example, the housing includes a central portion extending between front and rear portions thereof, with the support assembly being disposed between the front and rear portions and below the central portion. The support ring subassembly is attached to pivot within the housing through a ninety degree angle between a storage position, with the headband held within the package to extend vertically under the central portion of the housing, and an operational position, with the helmet/hood assembly removed from the package and with the headband extending horizontally outward beyond both of the lateral sides of the housing.

Preferably, the face shield is flexible and is flexibly attached to the housing. Then, the face shield is held in a position deflected relative to the housing, and in deflected condition reducing a required size of the package. The face shield is then attachable to the support ring subassembly with the helmet/hood assembly removed from the package and with the with the support ring subassembly in the operational position. Preferably, the housing holds an electrically driven fan, while the helmet/hood assembly includes a battery arranged to power the electrically driven fan.

In accordance with a third aspect of the invention, a helmet/hood assembly comprises a helmet having a face shield and an outwardly facing first magnetically attractable plate, a hood, and an accessory light powered by electricity, having a second magnetic plate held adjacent the first magnetically attractable plate by magnetic attraction between the first and second magnetically attractable plates with the hood extending between the first and second magnetically attractable plates.

The helmet may additionally include a third magnetically attractable plate, while the helmet/hood apparatus also includes a battery unit having a battery and a fourth magnetic plate held adjacent the third magnetically attractable plate by magnetic attraction between the third and fourth magnetically attractable plates with the hood extending between the third and fourth magnetically attractable plates, and an electrical cord extending between the battery unit and the accessory light.

Preferably, the magnetically attractable plates attached to the helmet are composed of ferromagnetic materials, while the magnetically attractable plates attached to the oter devices are permanent magnets.

BRIEF DESCRIPTION OF THE FIGURES

These and other aspects of the invention will be made apparent by reading the following specification in conjunction with the accompanying drawings, in which:

FIG. 1 is a schematic cross-sectional view of a conventional helmet/hood assembly.

FIG. 2 is a schematic view of a process for preparing the conventional helmet/hood of FIG. 1 for use;

FIG. 6 is a fragmentary perspective view of the helmet/hood assembly of FIG. 3, shown as packaged for storage and shipment, and FIG. 7 is a schematic view of a process for preparing the helmet/hood assembly of FIG. 3 for use.

DETAILED DESCRIPTION OF THE INVENTION

Figure 4:
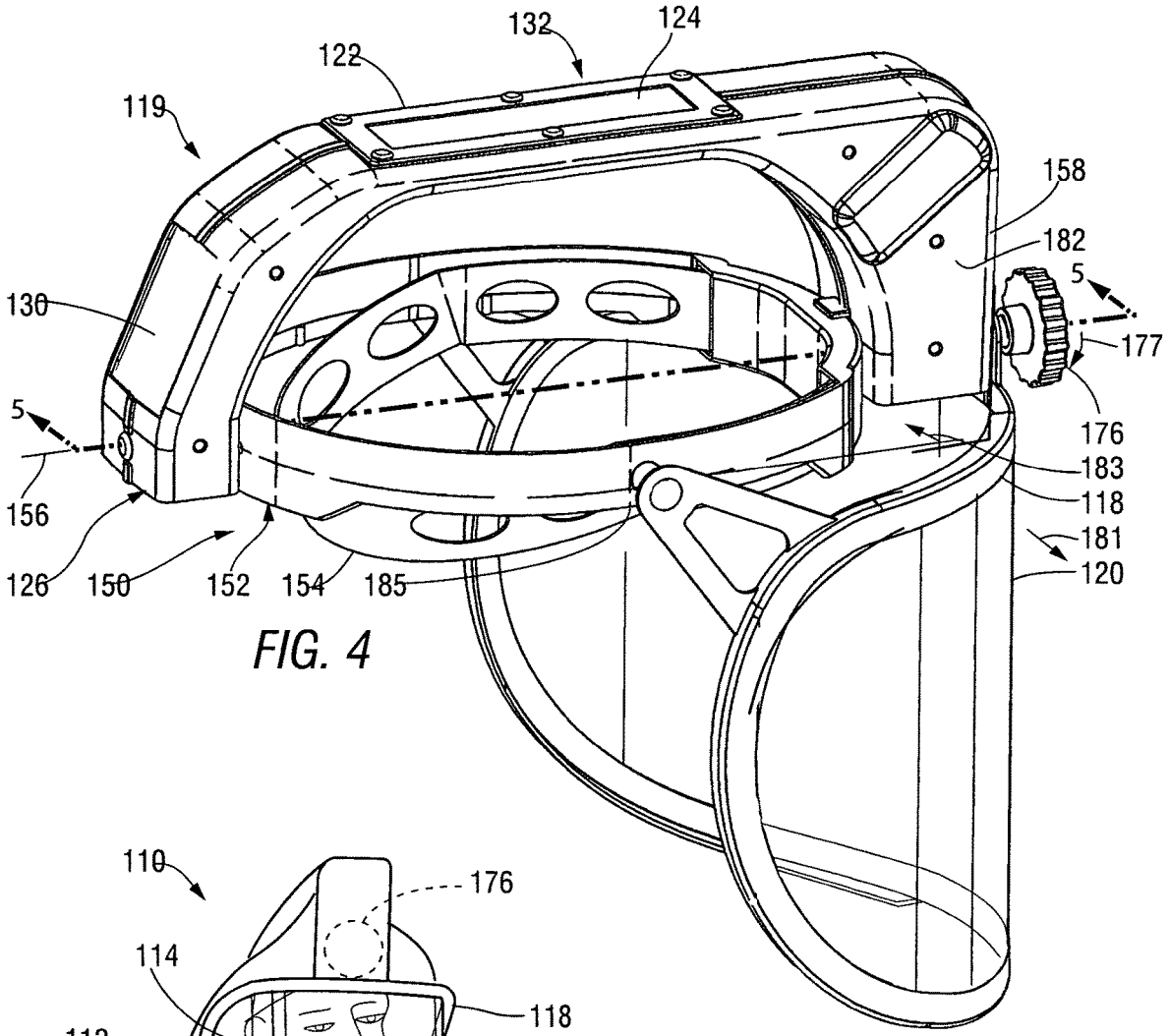
FIG. 4 is a side perspective view of the helmet/hood assembly of FIG. 3, shown with the hood removed to reveal internal structures.
Figure 3:
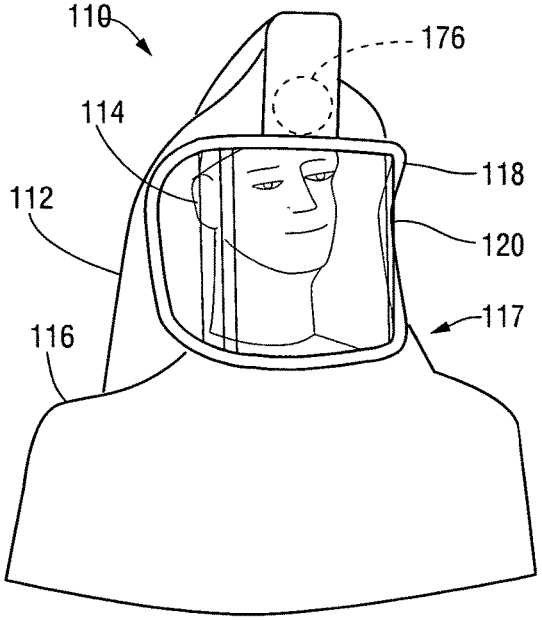
FIG. 3 is a front perspective view of a helmet/hood assembly built in accordance with the present invention.
Figure 5:
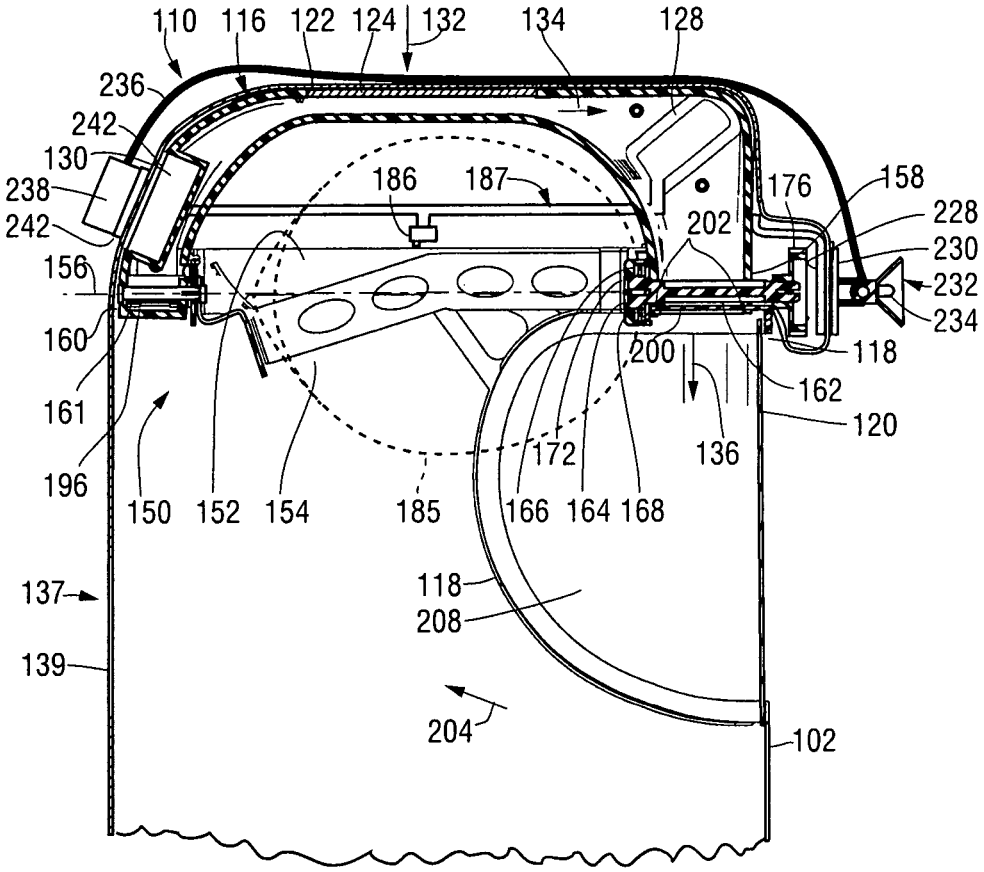
FIG. 5 is a fragmentary longitudinal cross-sectional elevation of the helmet/hood assembly of FIG. 3. taken as indicated by section lines 5-5 in FIG. 4.

FIGS. 3-5 show a helmet/hood assembly 110 including a hood 112 arranged for covering the head 114 and shoulders 116 of the wearer 118, with FIG. 3 being a perspective front view of the helmet/hood assembly 110 in place on the wearer 118, while FIG. 4 is a perspective side view of a helmet subassembly 119 within the helmet/hood assembly 110, taken from a right side thereof and from above, being shown with the hood 112 removed to reveal details of the helmet subassembly 119, and while FIG. 5 is a cross-sectional elevation of the helmet/hood assembly 110, taken as indicated by section line 5=5 in FIG. 4.

The hood 112 is fastened to a front frame 118 holding a curved transparent face shield 120 and to an upper frame 122 holding an air filter 124. As shown particularly in FIG. 5, the helmet subassembly 119 additionally includes a housing 126 holding an electric fan 128 powered by a battery 130, with the housing 126 serving as an air duct. The fan 128, which is, for example, a centrifugal flow device, pulls air inward, in the direction of arrow 132, through the filter 124, moves the air forward, in the direction of arrow 134, within the housing 126 to be exhausted downward, in the direction of arrow 136, within the hood 112 and the face shield 120. As shown in FIG. 5, the hood 112 additionally includes a posterior air outlet 137, covered by an air filter 139.

It is noted that the helmet/hood assembly 110 is configured to produce a constant flow of fresh air through the helmet/hood apparatus 110, with air being drawn through the filter 124 from a space 140 above the helmet/hood apparatus 110. The posterior air outlet 137, which is provided so that the flow of fresh air can easily be maintained. In particular, air is taken from the space 140 above the helmet/hood assembly 10 because this space, being away from the space in which blood splatter is likely to occur, is naturally free of airborne contamination, and because hospitals provide patterns of airflow to keep such spaces free from contamination. This configuration has a significant advantage over the prior art devices described above in reference to FIG. 1, which lack a provision for pulling air inward through the top of the hood. The constant flow of fresh air prevents an accumulation of carbon dioxide within the helmet hood assembly 110.

It is further noted that supplying the battery as a part of the disposable helmet/hood assembly 110 provides the present invention with significant advantages over the use of a rechargeable battery in prior art devices, as described above in reference to FIGS. 1 and 2. The difficulties of handling batteries through a recharging process are eliminated, and the helmet/hood assembly 110 becomes a becomes a self-contained electrical device with its own power source, allowing its use without additional provisions in areas where electrical power is not available, such as remote locations and disaster areas.

The helmet subassembly 119 further includes a support ring subassembly 150 for supporting the helmet/hood assembly 110 on the head 114 of the wearer 118. The support ring subassembly 150 in turn includes a support ring 152 extending loosely around the head 114 and a headband 154 that can be adjusted to extend more tightly or more loosely around the head 114. The support ring subassembly 150 is mounted to pivot within the housing 126 about a pivot axis 156 extending between a front end portion 158 of the housing 126 and the rear end portion 160 thereof, with the support ring subassembly being disposed below a central portion 161 of the housing 126. Both the front end portion 158 and the rear end portion extend downward from the central portion 161. For example, the pivot axis 156 is formed by a rear pivot pin 161, snapped in place within the rear end 160 of the housing and a front adjustment shaft 162, which holds an adjustment gear 164 in meshing engagement with an upper adjustment rack 166 and a lower adjustment rack 168. The adjustment racks 166, 168 are formed along opposite ends 170 of the headband 154, which extend in opposite directions within a slotted enclosure 172 formed to extend along the support ring 152. For example, the adjustment shaft 162 includes a central portion 173 having a cruciform cross-sectional shape.

For example, the support ring subassembly 150 is configured 54 so that, when the adjustment knob 176 is turned in the direction of arrow 177, both the upper adjustment rack 166 and the lower adjustment rack 168 are moved outward within the slotted enclosure 172, loosening the headband 154. On the other hand, when the attachment knob 176 is turned opposite the direction of arrow 177, both the adjustment racks 166, 168 are moved inward within the slotted enclosure 172, tightening the headband 154. The adjustment gear 164 and an external adjustment knob 176 are snapped onto the adjustment shaft 162 so that the adjustment knob 176 can be used to adjust the tightness of the headband 154. The support ring subassembly 150 is pivotally attached to the housing 126, with a front opening 178 and a rear opening 180, both extending through the support ring 152, being pivotally held on the front adjustment shaft 162 and the rear pivot pin 160. Even though the adjustment knob 176 is disposed under the hood 112, it can be easily felt and used through the hood 112 without moving a hand out of the sterile field area, providing a significant advantage over the prior art devices that have adjustment knobs in the back.

FIGS. 3-5 show the helmet-hood assembly 110 with the support ring subassembly 150 in an operational position, in which it would be worn and used. Referring particularly to FIG. 4, with the support ring 150 in the operational position, the headband 154 extends outward, in a horizontal direction indicated by arrow 181 beyond a lateral side 182 of the housing 126 through a substantial distance indicated as 183. The opposite side 184 of the headband 154 additionally extends horizontally outward from a lateral side (not shown) opposite the lateral side 182 through a similar distance 183.

Referring to FIG. 5, the support ring, subassembly 150 is pivoted about the pivot axis 156 through a ninety-degree angle between the operational position in which it is shown and a storage position, in which the headband 154 extends vertically, as shown by dashed lines 185 below the central portion 173 without extending outwardly beyond the lateral side 182 of the housing 126, and additionally without extending beyond the opposite lateral side (not shown) thereof. In this way, the width of the helmet/hood assembly 110 is substantially reduced for shipment and storage.

For example, moving the support ring subassembly 150 into the operational position to prepare the helmet/hood assembly for use may be used to turn the fan 128 on, with a switch 156 actuated by moving the support ring subassembly into the service position being provided within a circuit 187 connecting the fan 128 with the battery 130. In the example of FIG. 5, the switch 126 is closed by upward movement of an edgy 187*a* of the support ring 152 and held closed as long as the support ring subassembly 150 is held in the operational position.

FIG. 6 is a fragmentary perspective view of the helmet/hood assembly 110 within a 12.7 cm by 28 cm by 35.5 cm (5 in by 11 in by 14 in) package 188 for storage or shipment. The support ring subassembly 152 us shown as being disposed at an oblique angle, between the operational position and the storage position, allowing the depiction of details within the support ring subassembly 152. Referring to FIGS. 4 and 6, it is rioted that the helmet subassembly 119 additionally includes several stabilizing members releasably holding the support ring subassembly 150 in the operational position, as shown in FIGS. 11-3, by preventing rotation of the support ring subassembly 150 about the pivot axis 156. For example, the stabilizing members include a pair of attachment structures 192 that are snapped into place on to extend inward within openings 194 at each side 195 of the support ring 152, and a detent pin 196 extending outward from a rear portion 198 of the support ring 152. When the attachment structures 192 and the detent pin 196 are not connected to their mating structures, the support assembly can be rotated in either direction between the operational position of FIGS. 4 and 5, and the storage position.

As shown in FIG. 5, the front frame 118 and the face shield 120 are attached to the housing 126 by a flexible tab 200 extending through slots 202 within the housing 126. When the attachment structures 192 and the detent pin 198 are not connected to their mating structures, the front frame 228 and the face shield 120 can be pivoted inward and upward, in the direction of arrow 204 by deflecting the flexible tab 200, reducing the space required for the front frame 118 and the face shield 120 within the package 188 Furthermore, when the attachment structures 192 are not connected with their mating structures with the support assembly in the storage of thee position of FIG. 6, the opposite sides 208 of the face shield 120 are squeezed into the shape shown in FIG. 6 when the helmet/hood assembly 110 is placed in the package 188, additionally reducing the space required in the package 186.

FIG. 7 is a schematic view of the flow of parts within a hospital to provide helmet/hood assemblies 110 as needed for operating room personnel. In this process, the helmet/hood assembly 119, packaged as described above in reference to FIG. 6, is received from a supplier at 210 and stored in helmet/hood assembly storage 212. When it is time to prepare the helmet/hood assembly 110 for placement on a wearer 118, in step 214, the helmet/hood assembly 110 is removed from the package 188 and the support ring subassembly 150 and the face shield 120 are aligned into the operational configuration of FIGS. 3-5. As the support ring subassembly 150 is thus rotated into position, the detent pin 196 moves into place to lock the support ring subassembly 150 in place. As the face mask 120 is additionally brought into position, the attachment structures 192 are brought into alignment with the openings 194 in each side 195 of the support ring 152 and are snapped into place within these openings 194 so that the support ring subassembly 150 and the face shield 120 are subsequently retained in the operational configuration. The helmet/hood assembly 110 is then placed on the wearer 118. When the surgical procedure has been completed, the used helmet/hood assembly 216 is removed from the wearer 118 and discarded at location 218.

The method of providing the helmet/hood assembly 110 as a single, disposable packaged unit provides the present invention with a number of significant advantages over the prior art devices described above in reference to FIGS. 1 and 2. The helmet/hood assembly 110 is easily provided and stored in sterilized packaging. There is no need to replace individual items, such as sweat bands and a face shield so that the apparatus can be reused. Concerns that infectious agents may build up within a helmet as it is used by multiple wearers and that such infections agents may be spread from one area to another as the helmet is moved around are eliminated. The process of preparing the apparatus within the hospital for use by and individual wearer is greatly simplified.

Referring again to FIG. 5, the helmet/hood assembly 110 may be optionally provided with an outwardly facing magnetically attractable plate 228 in a front portion of the helmet subassembly 119, such as in front of the adjustment knob 176. The first magnetically attractable plate 228 is attracted to a second magnetically attractable plate 230 within an accessory light 232, which is therefore held in place on the helmet subassembly 119 by a magnetic field extending between the magnetically attractable plates 228, 230. For example, the first magnetically attractable plate 228 is composed of a ferromagnetic material, while the second magnetically attractable plate 230 is a permanent magnet. The accessory light 232 includes an electrically operated light 234, connected by an electrical cable 236 to a battery unit 238. Preferably, the helmet subassembly 119 additionally includes a third magnetically attractable plate 240, which attracts a fourth magnetically attractable plate 242 to hold the battery unit 238 in place on the helmet/hood assembly 110. For example the third magnetically attractable plate 240 is composed of a ferromagnetic material, while the fourth magnetically attractable plate 242 is a permanent magnet.

While the invention has been described in terms of preferred embodiments with some degree of particularity, it is understood that this description has been given only by way of example, and that many changes can be made without departing from the spirit and scope of the invention, as defined in the appended claims.

What is claimed is:

1. An apparatus comprising:

a housing including a front portion, a rear portion, two opposite lateral sides, an upper surface, a lower surface, and a central portion extending between the front and rear portions;

a support ring subassembly including a slotted member holding a headband configured to extend around a human head and to be adjustable to fit on the human head, wherein the support ring subassembly is disposed between the front and rear portions of the housing and below the central portion of the housing, and wherein the support ring subassembly is attached to pivot about a longitudinal axis through a ninety-degree angle within the housing, below the central portion, between an operational position, with the headband extending horizontally outward beyond each of the opposite lateral sides, and a storage position, with the headband extending vertically entirely below the central portion; wherein the longitudinal axis divides the support ring subassembly into a first portion and a second portion such that the first portion and the second portion are opposite one another, the first portion and the second portion being opposite one another in the operational position and the storage position, wherein rotation of the first portion automatically rotates the second portion;

a face shield, including a flexible transparent film sheet, attached to the front portion of the housing to extend downward from the front portion of the housing, wherein the face shield is configured to extend in front of a face of a human head held within the headband with the support ring subassembly in the operational position, a front adjustment shaft and a rear pivot pin forming the longitudinal axis, wherein the front adjustment shaft is disposed at the front portion of the housing and wherein the rear pivot pin is disposed at the rear portion of the housing, wherein the support ring subassembly is attached to pivot within the housing about the longitudinal axis by being pivotally attached to the front adjustment shaft and by being attached to the rear pivot pin extending coaxial to the front adjustment shaft through the rear portion of the housing; and an attachment structure extending inward from each side of the face shield, wherein, with the support ring subassembly in the operational position, each attachment structure is configured to be attached to one of the attachment openings in the support ring subassembly to hold the support ring subassembly in the operational position, wherein, with at least one of the attachment structures of the face shield engaging one of the openings of the support ring subassembly, turning the front adjustment shaft in a first direction causes the headband to tighten, while turning the front adjustment shaft opposite the first direction causes the headband to loosen, and wherein, with each attachment structure of the face shield not attached to one of the attachment openings in the support ring assembly, the support ring subassembly is attached to rotate in either direction between the operational position and the storage position.

2. The apparatus of claim 1, wherein, the front adjustment shaft extends outward, in front of the front portion of the housing, the apparatus additionally comprises an adjustment knob, attached to the front adjustment shaft in front of the front portion of the housing, the apparatus additionally comprises a hood, including a sheet of flexible material fastened to the housing to extend downward and outward from an upper surface of the housing and a front opening, the hood is additionally fastened to the face shield with the face shield extending within the front opening of the hood, and the sheet of flexible material covers the adjustment knob, and the adjustment knob is configured to be felt and rotated through the sheet of flexible material.

3. The apparatus of claim 2 wherein: the apparatus includes an adjustment gear attached to an inner end of the front adjustment shaft, and disposed within the slotted member and the headband includes a curved central portion and opposite end portions having racks extending within the slotted member to engage opposite sides of the adjustment gear.

4. The apparatus of claim 3, wherein the upper surface of the housing includes an air inlet opening, the lower surface of the housing includes an air outlet opening inwardly adjacent the face shield, the housing forms an air duct holding an electrically driven fan moving air from the inlet opening of the upper surface and the outlet opening of the lower surface, the hood includes an air inlet opening held adjacent the air inlet opening of the upper surface of the housing and a posterior air outlet opening disposed below the rear portion of the housing, and the housing additionally holds a battery that is electrically connected to the electrically driven fan only when the support ring subassembly is in the operational position.

5. A disposable helmet comprising:

a support ring subassembly that is configured to extend around a user's head, said support ring subassembly having an anterior portion and a posterior portion;

a housing including a front portion, a rear portion, two opposite lateral sides, and upper surface, a lower surface, and a central portion extending between the front and rear portions, said housing comprising an air duct extending from an air inlet positioned along the upper surface of the housing, to an air outlet positioned along the lower surface of the housing proximate the front portion of the housing; and an electrically powered fan positioned within the air duct so as to pull air into the air inlet and through the air duct, and move air out of the air outlet, wherein the support ring subassembly is disposed between the front and rear portions of the housing and below the central portion of the housing, and wherein the support ring subassembly is attached to pivot about a longitudinal axis extending through the housing, below the central portion, between (1) an operational position, with the support ring subassembly extending horizontally outward beyond each of the opposite lateral sides, and (2) a storage position, with the support ring subassembly extending vertically below the central portion; wherein the longitudinal axis divides the support ring subassembly into a first portion and a second portion such that the first portion and the second portion are opposite one another, the first portion and the second portion being opposite one another in the operational position and the storage position, wherein rotation of the first portion automatically rotates the second portion.

6. The helmet of claim 5, wherein the support ring subassembly comprises a support ring and a headband.

7. The helmet of claim 5, wherein the air inlet extends horizontally along the upper surface of the housing.

8. The helmet of claim 7, wherein the air inlet is surrounded by portions of the upper surface of the housing, and (i) the air inlet and (ii) the portions of the upper surface of the housing are within a horizontal plane.

9. The helmet of claim 5, wherein movement of said support ring subassembly from (i) the storage position into (ii) the operational position turns on the fan.

10. The helmet of claim 9, further comprising a switch that is actuated by moving the support ring subassembly into the operational position.

11. The helmet of claim 5, further comprising a face shield connected to the housing and the support ring subassembly.

12. The helmet of claim 11, further comprising a hood configured to cover a user's head and shoulders.

13. A disposable helmet comprising:

a support ring subassembly that is configured to extend around a user's head, said support ring subassembly having an anterior portion and a posterior portion;

a housing including a front portion, a rear portion, two opposite lateral sides, an upper surface, a lower surface, and a central portion extending between the front and rear portions, said housing comprising an air duct extending from an air inlet positioned along the upper surface of the housing, to an air outlet positioned along the lower surface of the housing proximate the front portion of the housing; and an electrically powered fan positioned within the air duct so as to pull air into the air inlet and through the air duct, and move air out of the air outlet, wherein the support ring subassembly is disposed between the front and rear portions of the housing and below the central portion of the housing, and wherein the support ring subassembly is attached to pivot about a longitudinal axis extending through the housing, below the central portion, between (1) an operational position, with the support ring subassembly extending horizontally outward beyond each of the opposite lateral sides, and (2) a storage position, with the support ring subassembly extending vertically below the central portion; wherein rotation of the support ring subassembly from the storage position into the operational position turns on the fan.

14. The helmet of claim 13, further comprising a switch that is actuated by moving the support ring subassembly into the operational position.

15. The helmet of claim 13, wherein the support ring subassembly comprises a support ring and a headband.

16. The helmet of claim 13, wherein the air inlet extends horizontally along an upper surface of the housing.

17. The helmet of claim 16, wherein the air inlet is surrounded by portions of the upper surface of the housing, and (i) the air inlet and (ii) the portions of the upper surface of the housing are within a horizontal plane.

18. The helmet of claim 13, further comprising a face shield connected to the housing and the support ring subassembly.

19. The helmet of claim 18, further comprising a hood configured to cover a user's head and shoulders.

* * * * *